US010130134B2

(12) United States Patent
Blair

(10) Patent No.: US 10,130,134 B2
(45) Date of Patent: Nov. 20, 2018

(54) PROTECTIVE HEADGEAR

(71) Applicant: Mary Lynne Blair, Newport (AU)

(72) Inventor: Mary Lynne Blair, Newport (AU)

( * ) Notice: Subject to any disclaimer, the term of this patent is extended or adjusted under 35 U.S.C. 154(b) by 632 days.

(21) Appl. No.: 14/616,567

(22) Filed: Feb. 6, 2015

(65) Prior Publication Data

US 2015/0216248 A1 Aug. 6, 2015

Related U.S. Application Data

(62) Division of application No. 13/164,704, filed on Jun. 20, 2011, now Pat. No. 8,978,167.

(30) Foreign Application Priority Data

Jun. 18, 2010 (AU) ..... 2010902662

(51) Int. Cl.

| | |
|---|---|
| ***A42B 1/08*** | (2006.01) |
| ***A42B 3/00*** | (2006.01) |
| ***A42B 3/12*** | (2006.01) |
| ***A42B 3/28*** | (2006.01) |

(52) U.S. Cl.

CPC ..... *A42B 3/125* (2013.01); *A42B 1/08* (2013.01); *A42B 3/128* (2013.01); *A42B 3/28* (2013.01)

(58) Field of Classification Search

CPC ..... A42B 1/08; A42B 3/125; A42B 3/128; A42B 3/28

See application file for complete search history.

(56) References Cited

U.S. PATENT DOCUMENTS 5,575,017 A * 11/1996 Hefling ..... A42B 3/145 2/418
5,829,065 A * 11/1998 Cahill ..... A42B 3/08 2/418
6,397,399 B1 * 6/2002 Lampe ..... A42B 1/008 2/171.2

* cited by examiner

*Primary Examiner* — Anna Kinsaul

(74) *Attorney, Agent, or Firm* — Straub & Straub; Michael P. Straub; Stephen T. Straub

(57) ABSTRACT

A protective headgear device including a fabric cap (102) into which a hard shell (120) of reinforced fibers is inserted. A foam liner 140 or foam inserts (1500) are secured to the hard outer shell 120 and serve a shock absorbing function. The foam liner (14) and/or foam inserts (120) include or form grooves and/or channels used to direct hot air towards the top center of the headgear assembly where the hot air can be vented through holes which extend through the cap (102) and hard outer shell (120). The holes may pass through the foam liner 140 or meet up with holes on channels in or between the foam inserts through which air can pass. The hard outer shell may be thinnest on top and thicker on the left and right sides. The center front and rear may be the same thickness as the top of the hard shell.

13 Claims, 14 Drawing Sheets

PROTECTIVE HEADGEAR

RELATED APPLICATIONS

The present application is related to Australian provisional patent application 2010902662, filed Jun. 18, 2010 which is hereby expressly incorporated by reference in its entirety.

FIELD OF THE INVENTION

The invention relates to protective headgear and, more particularly, protective headgear suitable for use as or with caps that may be worn at sporting or events.

BACKGROUND OF THE INVENTION

As the medical understanding of the potential long lasting and sometimes permanent effects of head trauma can have on affected individuals has increased, there has been an appreciation of the fact that protective headgear can reduce such trauma significantly in many cases.

Various potential applications for protective headgear include baseball games, golf matches and/or other sporting events where participants and/or fans may be hit with a ball or other flying object. In addition to ball impacts, a person may fall or collide with another person or object while cycling, skating, skate boarding, or taking part in activities on the ski slopes. such impacts may also be of concern.

While balls are often the objects which first come to mind as a potential source of head trauma at a sporting event, bottles and/or other objects thrown by crowds are another potential source of head trauma. While players are often the victims of ball strikes, police and/or other security forces are often the individuals who suffer from thrown bottles and/or impacts to the head from unruly fans or crowds. Accordingly, in addition to a need for protective headgear for sports participants, there is also a need for protective headgear for security personal and/or fans.

While wearing protective headgear at sporting events such as baseball and golf games offer some protection from impacts, conventional headgear has many drawbacks which remain to be addressed.

In order to provide adequate protection from baseballs and/or other objects which may reach speeds of many miles an hour, conventional approaches to protective headgear may result in helmets which are heavy, unsightly and/or have a tendency to trap heat. The unsightly nature of conventional helmets designs results in people tending not to wear them because they may cause an individual to stand out in a crowd or appear unsightly. The problem of weight and trapping of heat relate to a helmet being uncomfortable to wear due to the heavy nature of a helmet and/or the helmet causing the wearer to overheat leading to a tendency for the user to frequently remove the helmet and/or discontinue use.

At present, baseball/golf caps offer little protection for the head from flying balls while heavy helmets are unsuitable for many applications. In addition, while there are protective helmets that some people wear whilst carrying out activities such as bicycling and skateboarding, as noted above, existing helmets can be hot and uncomfortable. Furthermore, the weight can put undue stress on the delicate neck muscles because they are heavy and cumbersome which may contribute to broken necks in some accidents where the wearer is involved in a collision. With many existing helmets the wearer's sense of hearing is impaired because the ears are partially or fully covered by the helmet. This can cause anxiety and a lack of communication, which can lead to danger. Aesthetically, many people also prefer to wear their favorite hats instead of a cumbersome helmet.

Previous inventions and designs have proposed rigid plastic and foam inserts for hats such as those described in U.S. Pat. Nos. 4,439,871, 5,289,591, 5,519,895, 5,437,064, 5,657,492, 7,096,512.

There have been many protective headgear suggestions in the past. For example, U.S. Pat. No. 4,439,871 (referred to above) to Plastino, discloses a single shell consisting of a rigid unreinforced plastic which is relatively heavy and discloses an inner circular foam piece for the op of the head. The sides, front and back of the head fail to provide comprehensive protection to the head and the rigid plastic may tend to transfer the impact force rather than absorb and distribute it.

U.S. Pat. No. 5,289,591 to Anderson discloses a rigid plastic shell with many ventilation holes and a cutout section to fit inside an adjustable exterior baseball cap. The shell is unlikely to provide any real protection with the many holes weakening the strength and impact protection of the shell and the lack of a foam liner.

U.S. Pat. No. 5,519,895 to Barnes discloses a baseball type cap for over a sports helmet. It fits over the helmet with a special elastic band. There is no means of identification that a helmet is under the hat and there is no specific helmet to accompany the cap.

U.S. Pat. No. 5,269,026 to McManus discloses a safety liner, which is adjustable and only partially encircles the head.

In the inventor's previous U.S. Pat. No. 7,096,512 and Australian No. 2001293515, a double layer protective insert provides impact protection to the general skull area. While the described protective devices offers many advantages over previous protective systems, the design left room for improvement with regard to impact protection, heat dissipation, wear ability and/or the ability to detect that insert was in use under a cap.

In view of the above discussion, it should be appreciated that there is a need for new and improved protective headgear. It is an object of the present invention to address one or more the problems of the existing protection devices as are described above, and provide a protective insert and/or hat assembly which provides suitable protection to the wearer. While not necessary it would be desirable if at least in some embodiments the protective headgear has a pleasing aesthetic appearance while still providing suitable impact protection.

SUMMARY OF THE INVENTION

The sports hat appears to be that of an ordinary sports hat and the inventor has devised a system to show law enforcement officers or other interested parties that there is a protective insert under the hat. A hole cut out in the hat in a design shaped in a symbol associated with the sports use, shows the insert showing through the hole to prove that it is not an ordinary hat but that it contains a protective insert for a specific sports or spectator use.

The inserts may, and in some embodiments do use different colors to show the different sports and a symbol for each sport could be displayed as the hole with a matching symbol on the insert device. In this way, the sports hat is identified as having a protective insert device for the respective sport inside the sports hat.

The cloth liner has a pad that lines up with the ear cutout section of the outer shell for added comfort. The sports hat provides an inner comfort band to accommodate the cutout section for the ear.

This invention relates to a device for providing some protection to the head of the wearer of a hat, while the wearer is taking part in sporting activities or as a spectator. In one aspect, the device is particularly for protecting the wearer when a flying object, such as a golf ball or baseball, soccer ball or other flying object strikes the wearer's head (scenario 1). Scenario 1 does not require the use of a retention strap. In a second aspect, the device is for protecting the wearer's head in collision with the ground or other object (scenario 2), such as when the wearer is cycling, skate boarding, skating, snow boarding, or skiing. Scenario 2 requires the use of a permanent retention strap as required by helmet standards for the respective sports uses where the wearer is the possible flying object.

According to the present invention, there is provided a device for insertion into a sports hat or the like comprising:

- a solid outer shell with a cutout for the ear allowing better coverage to the temporal area;
- an inner layer of foam material, with a solid lower tapered edge with a cutout section for the ear, with the insert being sized and shaped for insertion into a typical sports cap such as a baseball cap or the like;
- an outer shell without an ear piece covering the ear and a mating inner foam liner system covering the ear in cases where more protection to the complete temporal area is required;
- a cutout section in the sports hat as identification to show that there is a protective insert contained within;
- a stretchy wide inner band that covers the ear cutout modified to hold the insert in place inside the sports hat;
- an optional cloth liner that attaches over the insert with a pad to cover the ear cutout section to provide comfort.

The outer shell of the present invention uses as the preferred embodiment the use of reinforced fibres such as polyethylene with the trade name Innegra™S with alternating layers of glass which is lightweight and has natural shock absorbing properties or rigid unreinforced plastic could be substituted as a heavier and less expensive alternative. The polyethylene Innegra™S is a new fabric that has similar shock absorbency properties to aramids such as Kevlar® with the polyethylene Innegra™S costing much less and providing similar shock absorption and weight. In cases where high ballistic impact protection is required, polyethylene can be used combined with aramids or carbons or other polyethylenes (trade names of Spectra® or Dyneema® or basalt to produce lightweight impact protection at reduced cost. The inner layer is composed of foamed plastic such as vinyl nitrile, Shox IV, expanded polystyrene (EPS) or any adaptive energy absorbing liner.

Thus the present invention provides a composite insert having a protective shell having a shock absorbing inner liner which together combine to provide sufficient protection for Scenario 1 or Scenario 2 and are relatively comfortable to wear and can also be fitted inside headwear such as baseball caps or toques or beanies which are more likely to be worn by e.g. the youth market or by golfers who do not wish to look out of the ordinary on a golf course by wearing a cumbersome protective helmet. The present invention is lightweight and absorbs sweat for comfort. Ventilation holes in the top also provide cooling. The cutout section for the ear allows the insert to sit lower on the head thus providing deeper impact protection to the delicate temporal area of the skull. Instead of vinyl nitrile, the inner layer might be HPDE (high density polyethylene), expanded polypropylene (EPP) or expanded polystyrene (EPS). Gaps (7*a*) in the foam for certain activities provide ventilation and the strategic location of the gaps does not compromise the impact results. A cutout hole shaped as a symbol in the front and/or rear of the hat shows the protective insert underneath.

In one particular preferred form of the invention, the outer shell is a thin lining made from a moulded compound utilizing reinforced fibres such as any fiberglass or aramid combined with alternating layers of polyethylene Innegra™S. The polyethylene Innegra™S performs well when it is sandwiched on the inside layers of the shell. The sides of the shell maybe implemented with a hybrid extra layer of polyethylene Innegra™S and glass or aramid to provide added impact protection as compared to other portions of the shell. Basalt can be used as a reinforced fiber that is less expensive than polyethylene and aramid and has good impact and lightweight properties. It can be used on its own or as a hybrid with glass. The sides have a flatter exposed area and require extra impact protection. This combination is lightweight yet provides additional protection from an impact.

In another form of the invention, the outer shell uses a rigid unreinforced plastic as a cheaper but heavier alternative as the outer shell.

In another form of the invention a solid foam liner with tapered edge and a cutout section for the ear of high density foam such as vinyl nitrile, EPP, EPS, HPDE or the like may be used to provide protection from an impact.

In another form of the invention a foam liner with gaps provides ventilation and provides impact protection in combination with the foam.

In another form of the invention, the cutout sections over the ear in both the outer shell and inner liner provide added protection to the temporal area of the skull in the case of an impact.

In another form of the invention the rear half of the insert device is lower than the front half of the insert device for better coverage for rear and complies with other standardized helmet tests such as for cycling or baseball batter's helmet.

In another form of the invention the outer sports cap can be manufactured to include a widened inner stretchy band with a section that provides a sleeve for the ear cutout section and lines up with the lower edge of the insert and holds the insert in place.

In another form of the invention the sports cap is deeper than the ordinary cap because it contains the insert device that adds space between the head and cap.

In another form of the invention the cloth liner has an ear cutout shape and thin padding along the lower edge of the ear cutout to provide comfort to the wearer.

In another form of the invention the cloth liner has a lower flap that slips into the sleeve opening of the outer cap at the ear cutout.

In another form of the invention slits or holes are punctured along the top of the outer shell and inner liner to provide ventilation.

In another form of the invention the outer shell and inner foam liners have an ear covering section for extra protection to the ear and full temporal area of the head.

In another form of the invention the cutout sections in the sports cap are made in the front and/or back of the cap to show that there is a protective insert underneath.

In another form of the invention the identification cutout sections are shaped in a symbol that pertains to the sporting use, such as a diamond shape for baseball, a golf flag for golf, a snowflake for the winter hat for general winter activities, a snowboard or ski and poles for snowboarding and a horse for equestrian use.

In another form of the invention the outer shell has a specific color for a specific use such as green for golf, white for baseball, red for winter sports, tan for equestrian sports uses.

In another form on the invention the colors of the outer shell could be made from glow-in-the dark pigment for better visibility.

In another form of the invention, a retention strap must be permanently attached to the device on at least one side of the outer shell and must be secured to the head in the second scenario in accordance with the standardized test requirements for the respective countries and sports. The prototype of the present invention passed the Australia/New Zealand Standardized retention strap requirements for pedal cycling when used according to the permanent rivet and mating snap attachment model embodying to the present invention described below.

The above described embodiments are only exemplary and are not intended to limit the scope of the invention. Numerous additional features and embodiments are described in the detailed description which follows.

DETAILED DESCRIPTION

Figure 1:
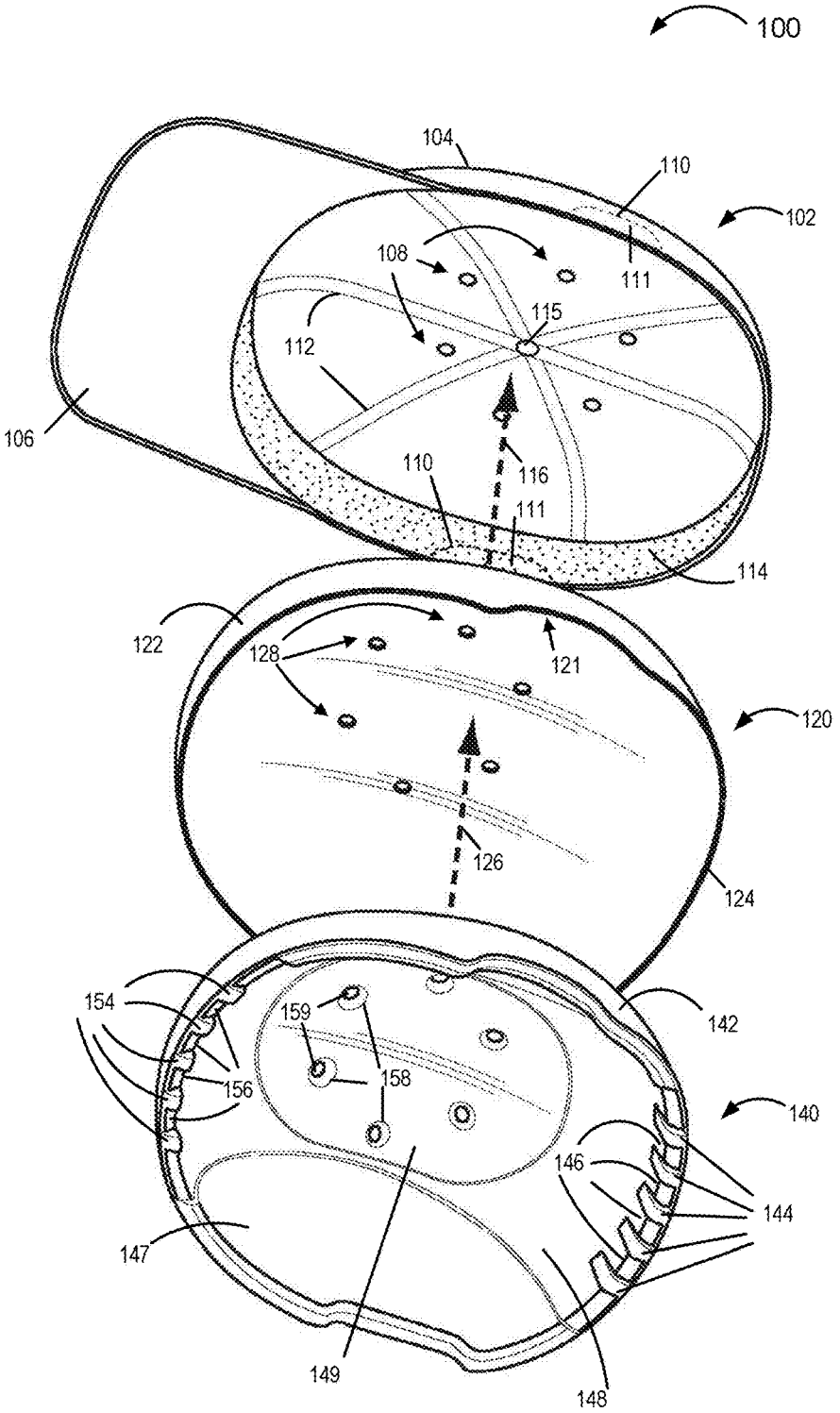
FIG. 1 illustrates an exemplary protective device in the form of headgear comprising a cap, an outer shell composed of reinforced fibers and/or a plastic material, and a corresponding inner foam liner with front and rear tapered ventilation slots and differing thicknesses of foam for different regions of the foam liner.

Referring to the drawings, FIG. 1 illustrates an exemplary protective device 100 in the form of headgear comprising a cap 102, an outer shell 120, and a corresponding inner foam liner 140. As illustrated by arrow 126, the foam liner is inserted into the hard outer shell 120. The foam liner 140 is normally secured to the hard outer shell via an adhesive or by molding the foam liner directly into the shell so that it is adheres and conforms to the inside surface of the hard outer shell. While shown as separate components, during use the foam inner liner is secured to the hard outer shell and remains attached thereto as a combined outer shell and foam liner assembly, referred to herein as the combined assembly 120, 140. The combined assembly can be inserted into the cap 102 when protection from impacts is desired as shown by arrow 116. Depending on the embodiment the thickness of the foam liner may vary. In some embodiments the thickness of the foam liner is between 4 mm and 32 mm. However, this range is only exemplary and other thicknesses are possible.

Advantageously, the combined assembly can be removed from the cap at times when impact protection is not required, e.g., during innings and/or when the wearer of the cap 102 is not concerned with the risk of an impact from an object or fall.

The cap 102 has the general appearance of a conventional baseball or golf cap and includes an outer fabric material 104, a brim 106, reinforcing fabric straps 112, and a fabric covered rivet 115 at the top of the cap 102. While from the outside the cap appears similar to conventional caps, in accordance with the present invention, the cap 102 includes an elastic band 114 around the inside rim of the cap 102 and a plurality of ventilation holes 108 positioned so that they will line up with corresponding ventilation holes of insert 120 and foam liner 140. Elastic band 114, in some embodiments, is relatively large in size, e.g., between 1¼" and 2". In some embodiments the elastic band 114 is combined with fabric and implemented in the form of a fabric stretch band. While being capable of absorbing sweat, the band serves the useful function of acting as a flap which can be bent or turned down as while the combined assembly (140, 120) is inserted or removed. The flap can be bent up into the position shown in FIG. 1 and used to retain the combined assembly inside the cap 102 with the ventilation holes 128, 159 in the combined assembly aligned with the holed 108 of the cap 102. The elastic flap, in some embodiments, is made from a loosely woven material allowing air to easily pass through the elastic band, e.g., elastic sweat band, with little resistance to air flow.

In some but not necessarily all embodiments sticking is used to secure the bottom edge of the elastic sweet band 114 to the bottom lip of the cap 102. Additional stitching 110 is used, in some embodiments, to form a reinforced area which conforms to the contour of an ear cutout 121 on the combined assembly. The stitching which may forms a raised area relative to the bottom of the cap which facilitates alignment of the combined assembly 120, 140 when it is inserted into the cap and helps retain the combined assembly in the cap in a relatively secure manner.

While in various embodiments the caps 102 are matched in size to the combined assembly 120, 140, the cap 102 may, and in some embodiments does, include an adjustable band at the back of the cap which can be adjusted to different sizes. In this manner, a single cap 102 can be used with a variety of different size combined inserts 120, 140.

The hard outer shell 120 may, and in some embodiments is made of reinforced fibers and/or a plastic material. In some embodiments, the hard outer shell is a molded or layered compound material utilizing reinforced fibres such as the new polyolefin Innegra™S, basalt, aramid (Kevlar® or Twaron®) or polyethylene (Spectra®, Dyneema® and a resin. Glass fibers may also be used. The top outer surface 122 of the hard outer shell is smooth. In one particular embodiment the hard outer shell is made from alternating layers of several of the materials. One particularly desirable combination has been found to be a set of alternating layers of materials as follows: 300 g2 m Glass, Innegra, Soric, Innegra, 300 g2 m Glass. Thus, in some embodiments, the hard outer shell is made of materials which change from layer to layer. In some embodiments the outer shell is made of at least 2 or more different fiber based materials. In some cases such as in the 5 layer example that is discussed above, at least 3 different reinforced fiber materials are used. Note that epoxy resin may be used in the making of the hard outer shell in addition to the fiber materials with the epoxy acting as a reinforcing agent. In some embodiments the hard outer shell has a thickness in the range of 1 mm to 2 mm in thickness. Different portions of the outer shell may include different numbers of material layers. In some embodiments left and right sidewalls include one or more additional layers of materials than the top of the hard outer shell.

In some embodiments the left and right sidewalls of the hard outer shell are constructed to have a thickness in the range of 0.12 to 0.16 inches in thickness at its thickest point, e.g., the left and right sidewall area above the ears. In some embodiments the maximum thickness of the hard outer shell is kept to between 0.13 to 0.15". In at least some such embodiments, the thinnest part of the shell may be in the range of 0.04 to 0.07" in thickness. This may be at the top center of the hard outer shell.

In many but not all embodiments, the hard outer shell 120 is colored, e.g., by using a colored plastic or resin or by painting the outside surface 122, a color which is intended to contrast with the outside color of the cap 102 or a design included thereon. Thus, the outer surface of the hard shell 120 is often colored a dark blue, black or some other color when the outside fabric of the cap 102 or symbol on the cap is a light color. Alternatively, the outside surface 122 of the outer shell 120 is colored a bright light color, e.g., when the hard shell 120 is to be used with a dark colored cap 102 or with a dark symbol on the cap.

Figure 11:
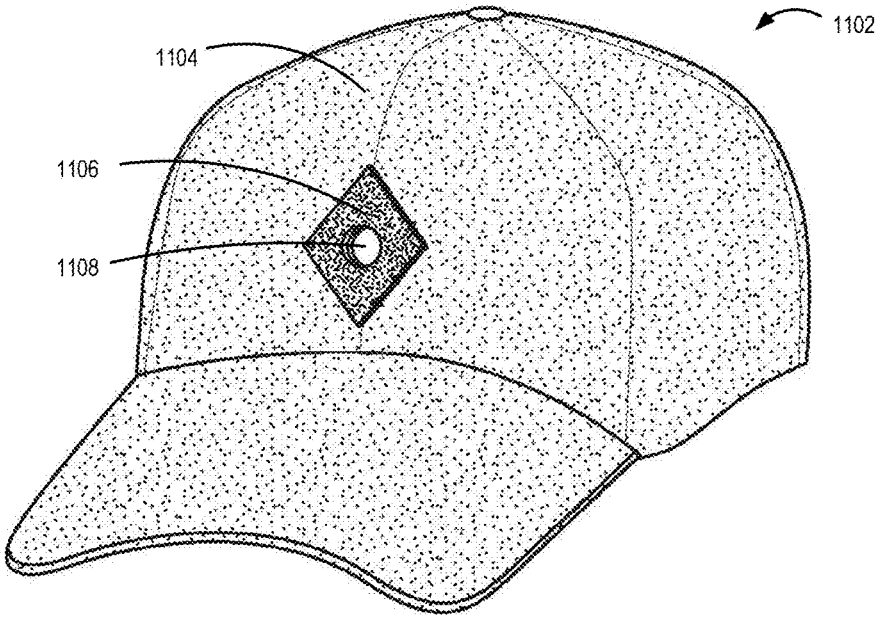
FIGS. 11 and 12 illustrate exemplary caps which may be used in either of the FIG. 1 or FIG. 9 embodiments including a hole through which the presence or absence of the hard outer shell may be observed without removal of the cap from an individual wearing one of the exemplary caps.
Figure 12:
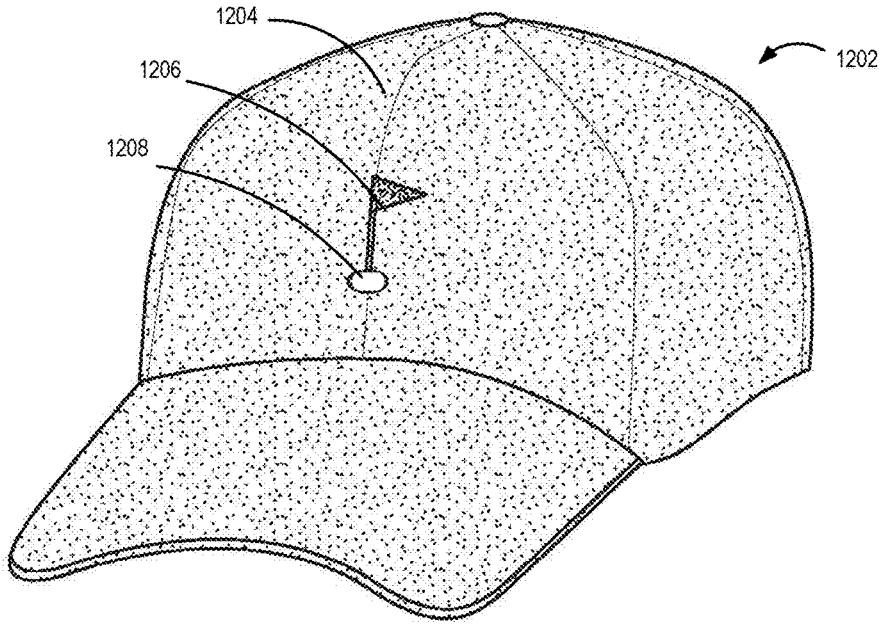

The coloration of the outside surface 122 is not important in all embodiments but can be desirable in some embodiments, particularly embodiments such as those shown in FIGS. 11 and 12. In FIGS. 11 and 12 the exemplary caps 1102, 1202 are covered in fabric 1104, 1204 and include one or more symbols 1106, 1206 stitched or glued to the cap. The symbols 1106, 1206 each include a hole 1108, 1208 through which the surface of the hard outer shell is visible. By using different colors for the surface of the hard outer shell and/or symbols 1106, 1206 and cap material 1104, 1204 it is easy for a coach or other observer to determine whether or not the combined shell and liner assembly is being used without requiring removal of the cap 1102, 1202 to make the determination. Thus, a coach can quickly determine if the team players are using the protective combined assembly with the cap at the appropriate times, e.g., when playing on the field.

In accordance with one feature of the invention, in some embodiments the left and right sidewalls of the hard outer shell are intentionally thicker than the other portions of the shell 120. The added thickness may be achieved by using one or more layers of reinforced material on the sides of the outer shell 120 than are used on the top and front/rear center portions of the hard outer shell. The added thickness provides increased protection to the left and right sides of the head providing added protection over the ears. Such an embodiment is particularly well suited to baseball applications where side impacts from baseballs maybe of concern. In other embodiments, e.g., those intended for golf ball or use by security personal, the hard outer shell maybe of generally uniform thickness.

Referring once again to FIG. 1, the foam liner will now be described in more detail. The exemplary foam liner 140 shown in FIG. 1 is particularly well suited for baseball application but is not limited to such applications. The thickness of the foam liner varies but can be considered as corresponding to three types of regions, i.e., front and rear regions 148, side regions 147 and a center top region 149. The thickness of the foam in each region takes into consideration impact concerns as well as heat dissipation concerns. As should be appreciated the thicker the foam the greater its insulating and heat retention effect.

In the FIG. 1 example, the center top region includes multiple vent holes 159 and corresponding tapered air flow guides 158 which direct air from the central region 149 through the holes 159. The center top region 149 is oval and shape and the thinnest part of the foam liner. The oval shape serves as an air collection pocket for collecting and directing hot air out through the top of the liner. Left and right side areas 147 are the thickest part of the liner 140 providing a high degree of protection from impacts to the side of the head. Front and rear model sections 148 are of intermediate thickness providing more impact protection than the top portion but less than the side portions 147.

As shown in FIG. 1 the front and rear inside portions 148 of the liner 140 each include a serious of ventilation grooves 156, 146 and raised notches 154, 144. The raised notches keep the grooves from being blocked by the head when the liner is worn on the head and allow hot air to flow through the upwardly tapered groves towards the top middle section 149 where the hot air is vented. The raised notches 154, 144 and ventilation grooves 156, 146 relive pressure for the wearer providing more comfort and a better fit.

The bottom edges of the shell 120 can be flat, tapers or rounded hover because it is relatively thin compared to the liner 140, the predominate shape at the bottom edge of the combined assembly 120, 140 is that of the foam liner 140. The edge of the foam liner is tapered and extends to or slightly beyond the edge of the hard outer shell 120. The taper helps guide the combined assembly 120, 140 into the groove created between the elastic band 114 and rim of the cap 102 and avoids a bulky edge which might be uncomfortable or unsightly.

Figure 2:
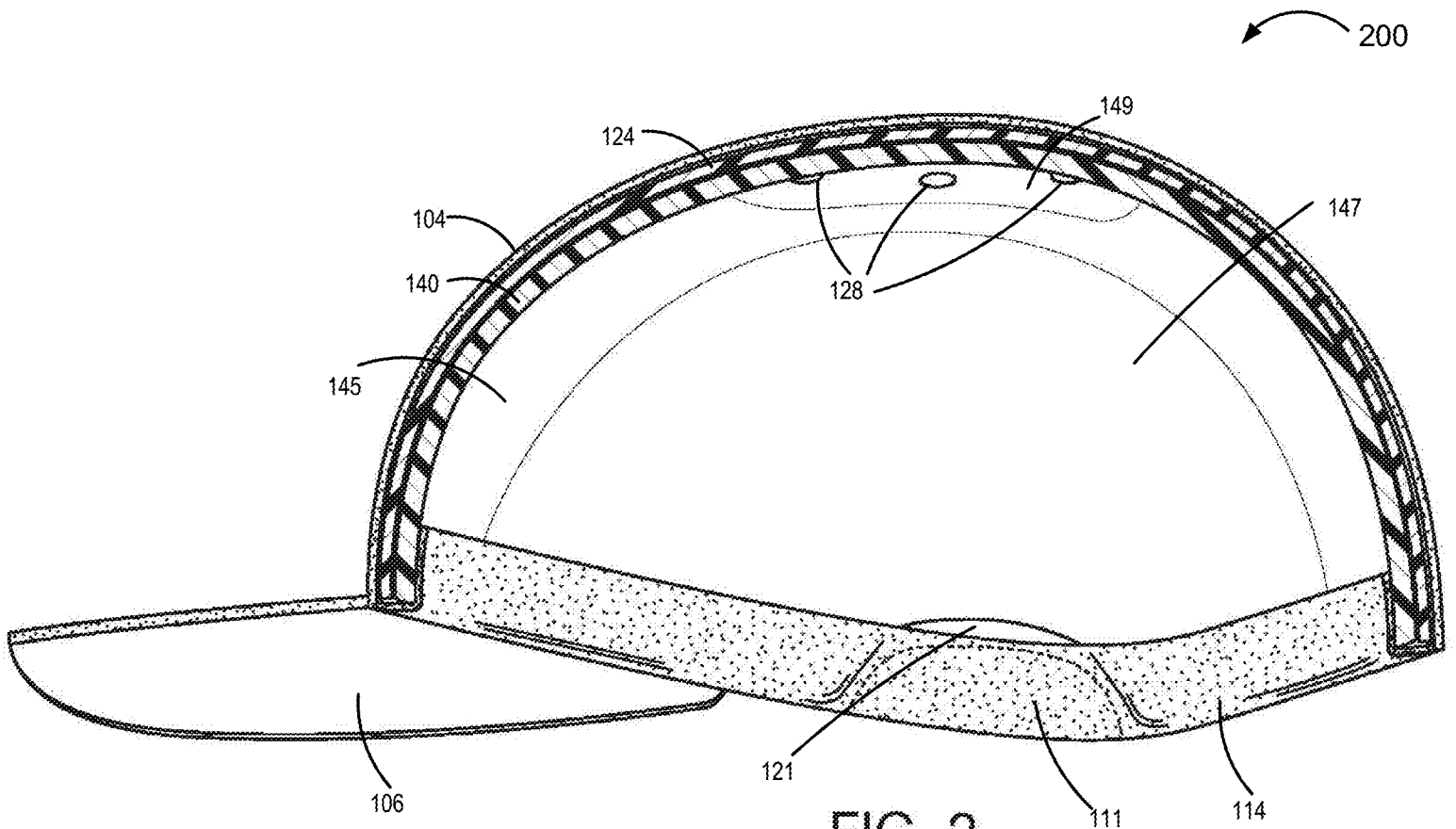
FIG. 2 illustrates a cross section of the assembled headgear shown in FIG. 1.

FIG. 2 shows a cross section 200 of an assembled protective device such as the piece of headgear shown in FIG. 1. Reference numbers used in FIG. 2 and the other figures which are the same as those used in FIG. 1 correspond to the same element as that discussed with regard to FIG. 1 and thus will not be discussed in detail again.

Note that in FIG. 2 the snug fit between the fabric cap material 104, hard outer shell wall 124 and foam liner 140 can be seen. Area 147 corresponds to the thicker sidewall portions of the hard outer shell 120 and foam liner 140. In the FIG. 2 embodiment, the elastic band 114 does not extent to completely cover the cut out 121 for the ear. However, in other embodiments the elastic material 114 extends further and fully covers the cutout 121. The stitched area 111 fits neatly into the ear cutout 121 as shown helping with the proper position and retention of inserted combined assembly.

Figure 3:
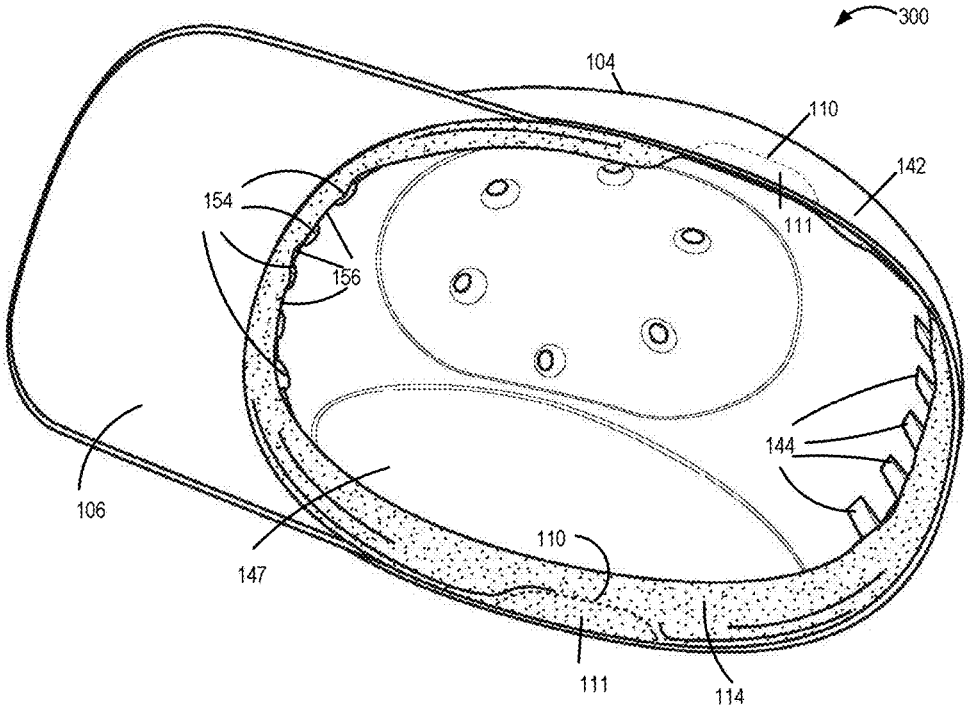
FIG. 3 is an angled bottom view of the assembled headgear shown in FIG. 2.

FIG. 3 is an angled bottom view 300 of the assembled headgear shown in FIG. 2. Note that in this embodiment the vent slots are not fully covered by the elastic material 114 allowing for air flow even if the elastic material 114 blocks the air flow to some extent.

Figure 4:
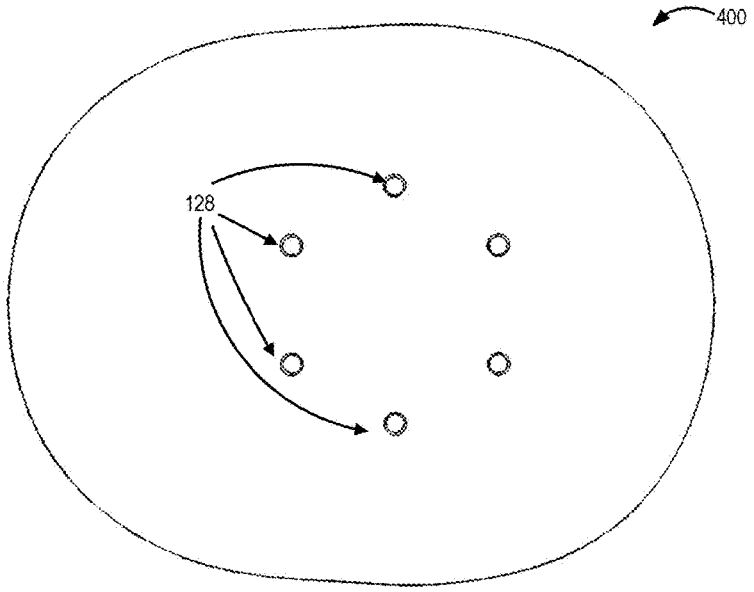
FIG. 4 is a top view of the outer shell of the exemplary headgear shown in FIG. 1.

FIG. 4 is a top view 400 of the outer shell 120 of the exemplary headgear shown in FIG. 1. Note that the outside surface 122 of the outer shell is smooth and includes vent holes 128 through which hot air can escape.

Figure 5:
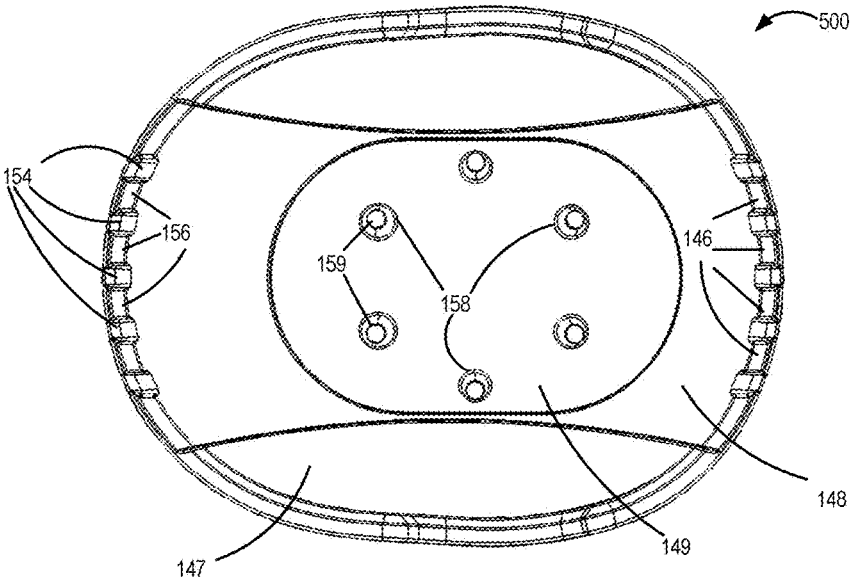
FIG. 5 is a bottom view of the combined outer shell and foam liner of the headgear assembly of FIG. 1.

FIG. 5 is a bottom view 500 of the combined outer shell 120 and foam liner 140 of the headgear assembly of FIG. 1. Note the vent tapered vent slots 156 and 146. also note the tapered regions 158 which direct air to the holes 159.

Figure 6:
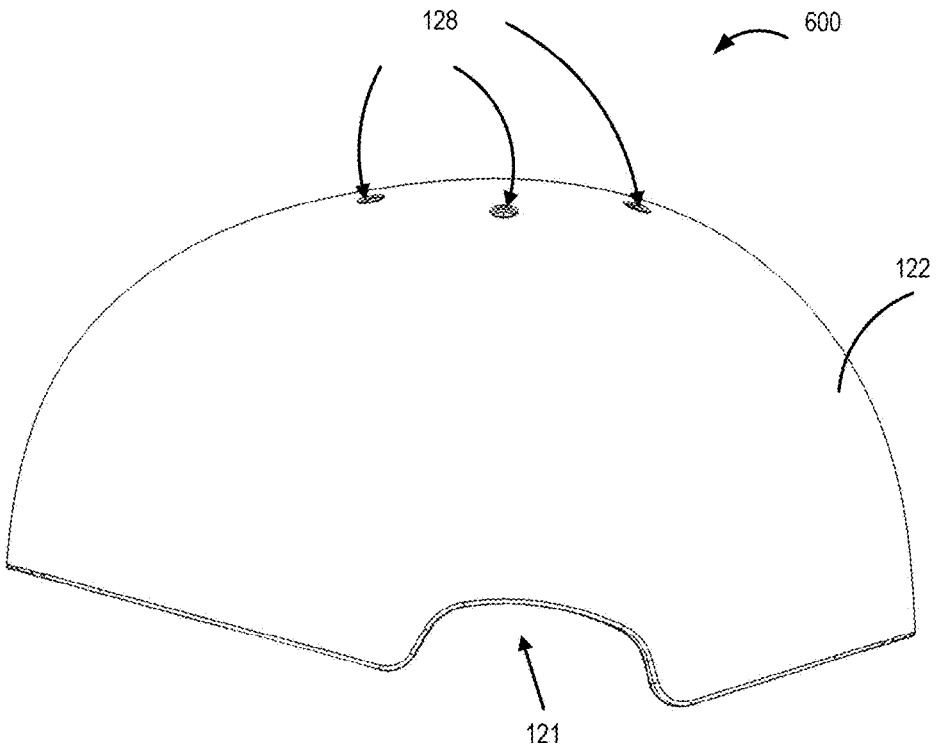
FIG. 6 is a left side view of the combined outer shell and foam liner of the headgear assembly shown in FIG. 4.

FIG. 6 is a left side view 600 of the combined outer shell and foam liner of the headgear assembly shown in FIG. 4. Note how the front of the combined outer shell and foam liner 122 is higher than the rear portion. See also how each cutout 121 is more of a half oval in shape than circular in shape. The generally flat top portion of the ear cut out allows for good seating of the combined assembly in the cap. Vent holes 128 are variable at the top of the assembly shown in FIG. 6.

Figure 7:
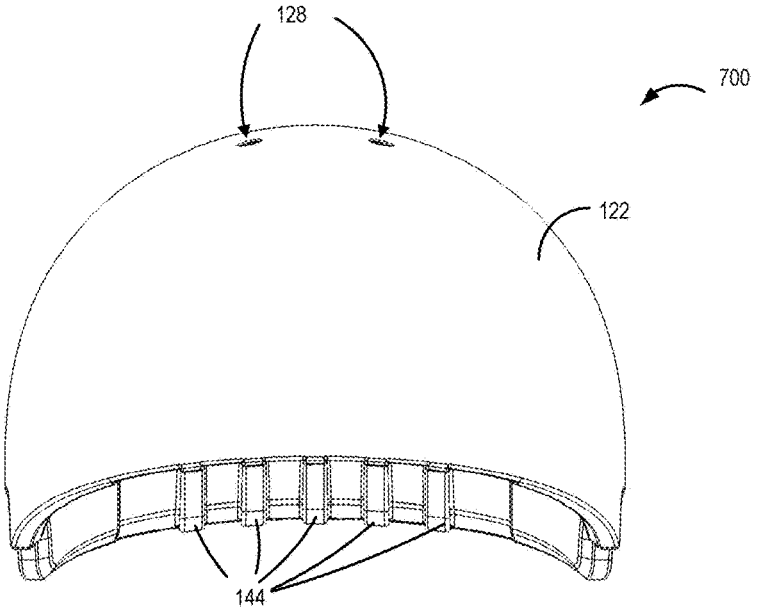
FIG. 7 is a front view of the combined outer shell and foam liner of the headgear assembly shown in FIG. 6.

FIG. 7 is a front view of the combined outer shell and foam liner of the headgear assembly shown in FIG. 6 and shown features which have already been described.

Figure 8:
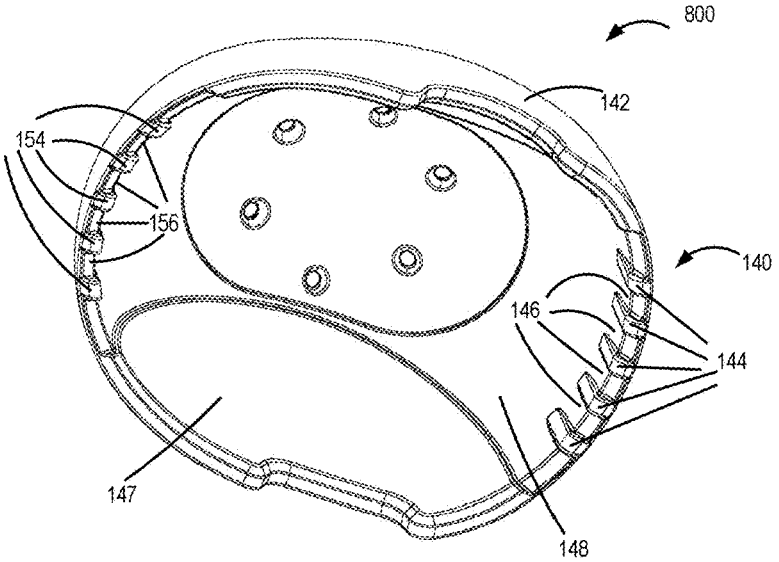
FIG. 8 is another bottom angled view of the combined outer shell and foam liner of the headgear assembly shown in FIGS. 4-6.

FIG. 8 is another bottom angled view of the combined outer shell and foam liner of the headgear assembly shown in FIGS. 4-6.

Figure 9:
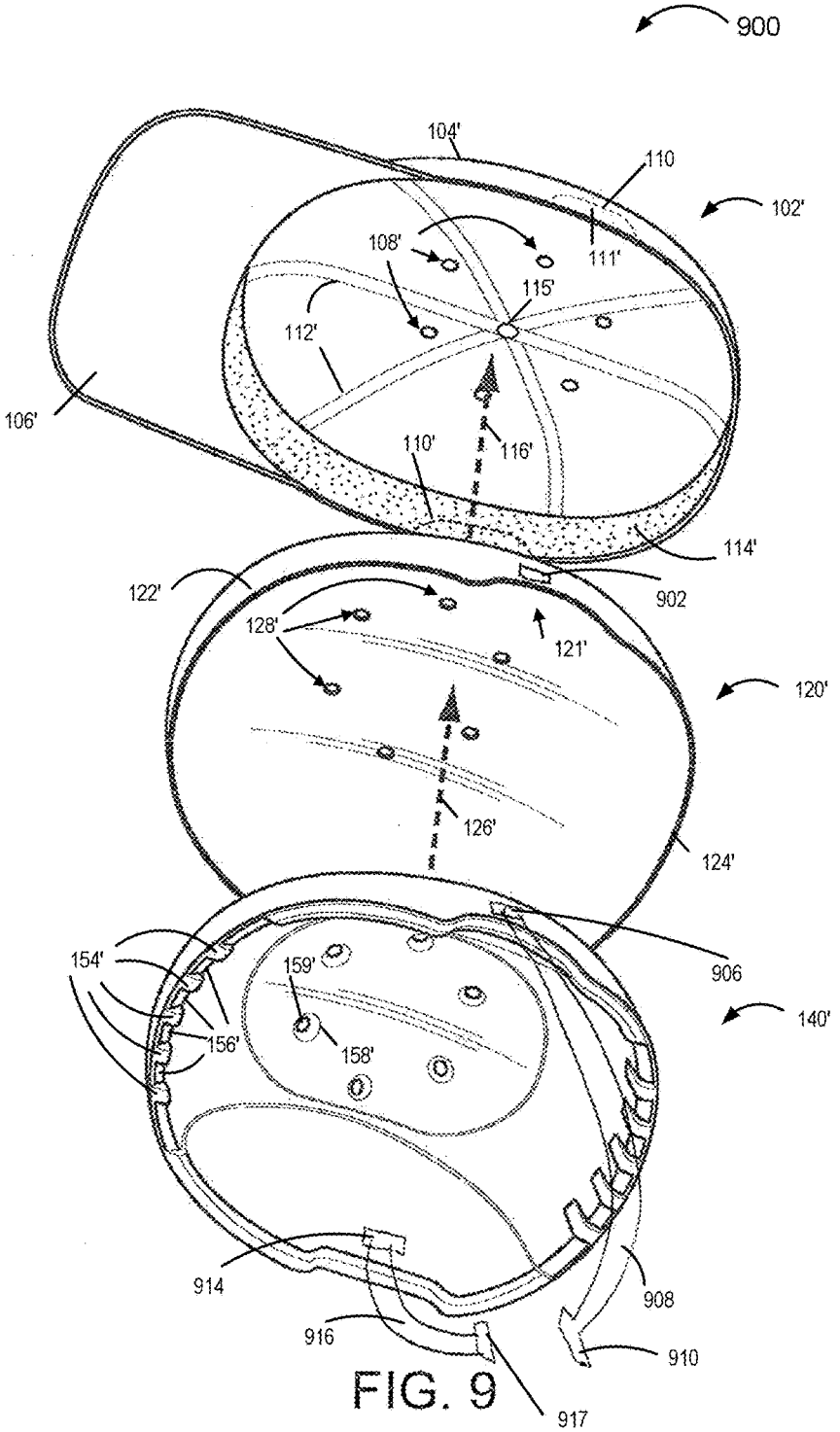
FIG. 9 illustrates exemplary headgear implemented in accordance with the invention that includes a chin strap.

FIG. 9 illustrates exemplary headgear 900 implemented in accordance with the invention that includes a chin strap. The chin strap includes left and right portions 916, 908 and a buckle comprising left and right buckle portions 917, 918. Hole 902 allows the chin strap to pass through the hard outer shell 120'. The end of the chin strap may be secured to the hard outer shell 124' though the use of a rivet or other securing device. The FIG. 9 embodiment is well suited for security forces, riders and/or skateboarders where a chin strap may be useful for keeping the helmet on the wear's head.

Figure 10:
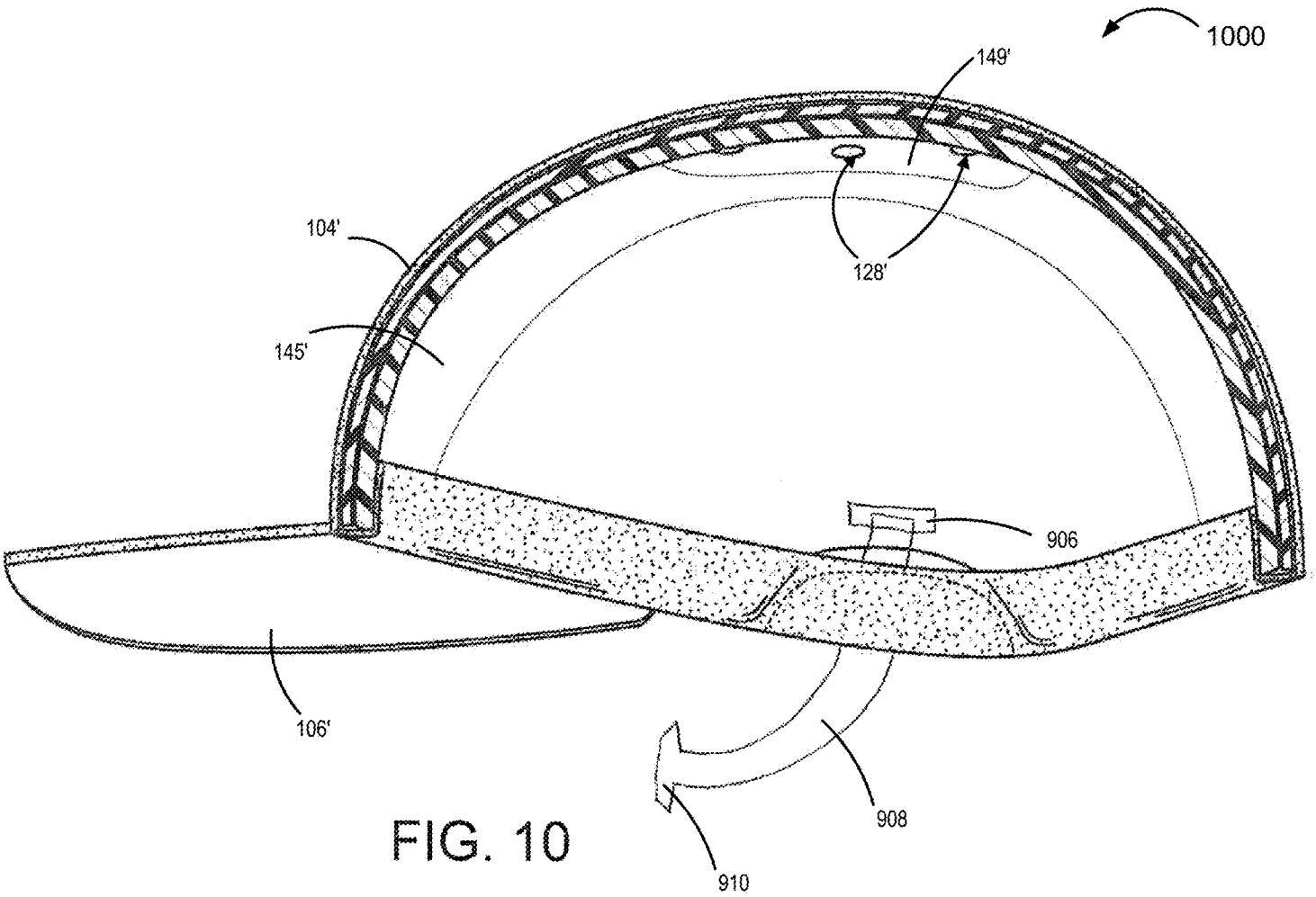
FIG. 10 is a side cross section view of the headgear shown in FIG. 9.

FIG. 10 is a side cross section view 1000 of the headgear shown in FIG. 9.

FIGS. 11 and 12 illustrate exemplary caps which may be used in either of the FIG. 1 or FIG. 9 embodiments including a hole through which the presence or absence of the hard outer shell may be observed without removal of the cap from an individual wearing one of the exemplary caps. These figures have been described above and this will not be described further here.

Figure 13:
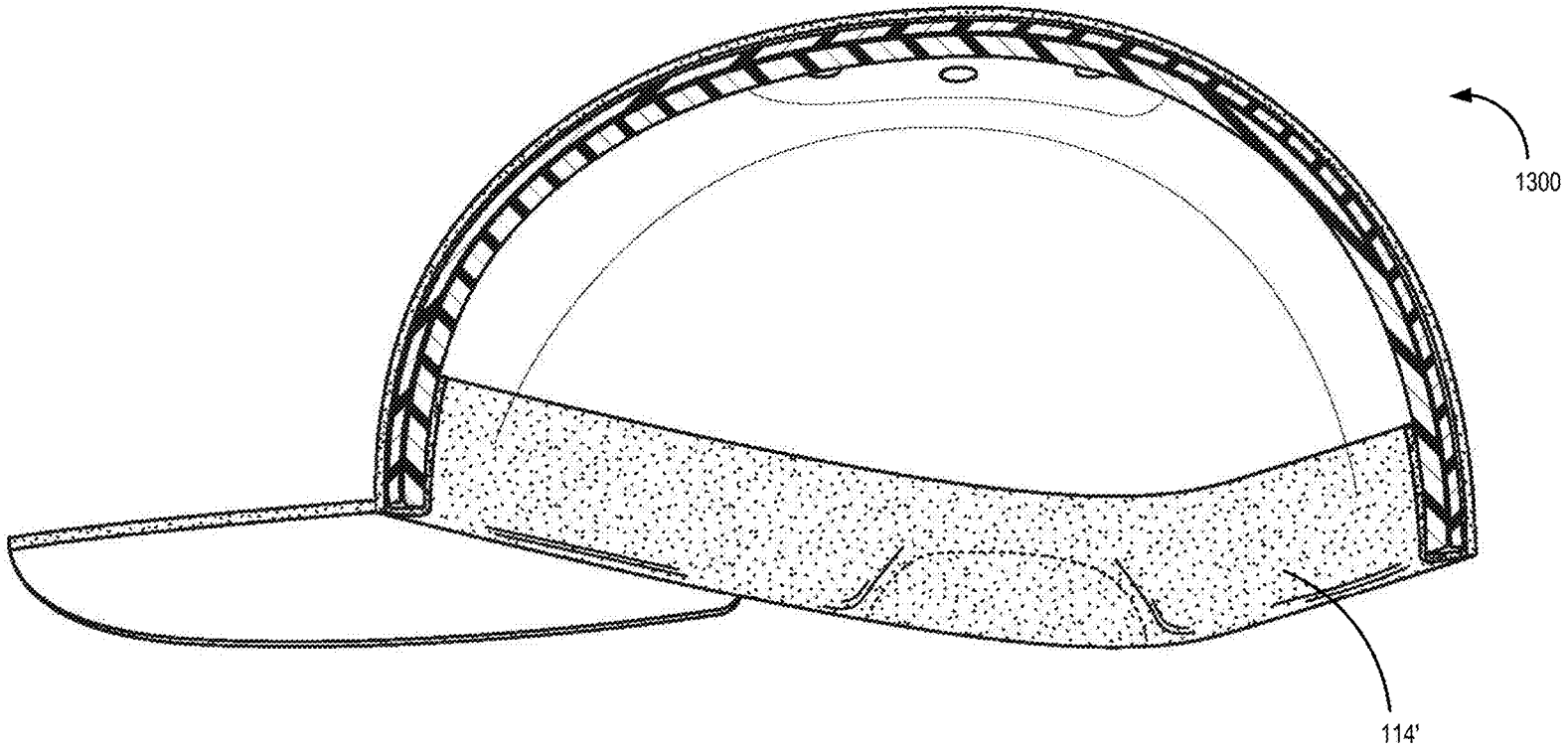
FIGS. 13 and 14 show a cap with an outer hard shell and foam liner inserted into a cap where the cap includes an elastic sweet band which covers the entire ear cut out portion of the foam liner and hard outer shell.
Figure 14:
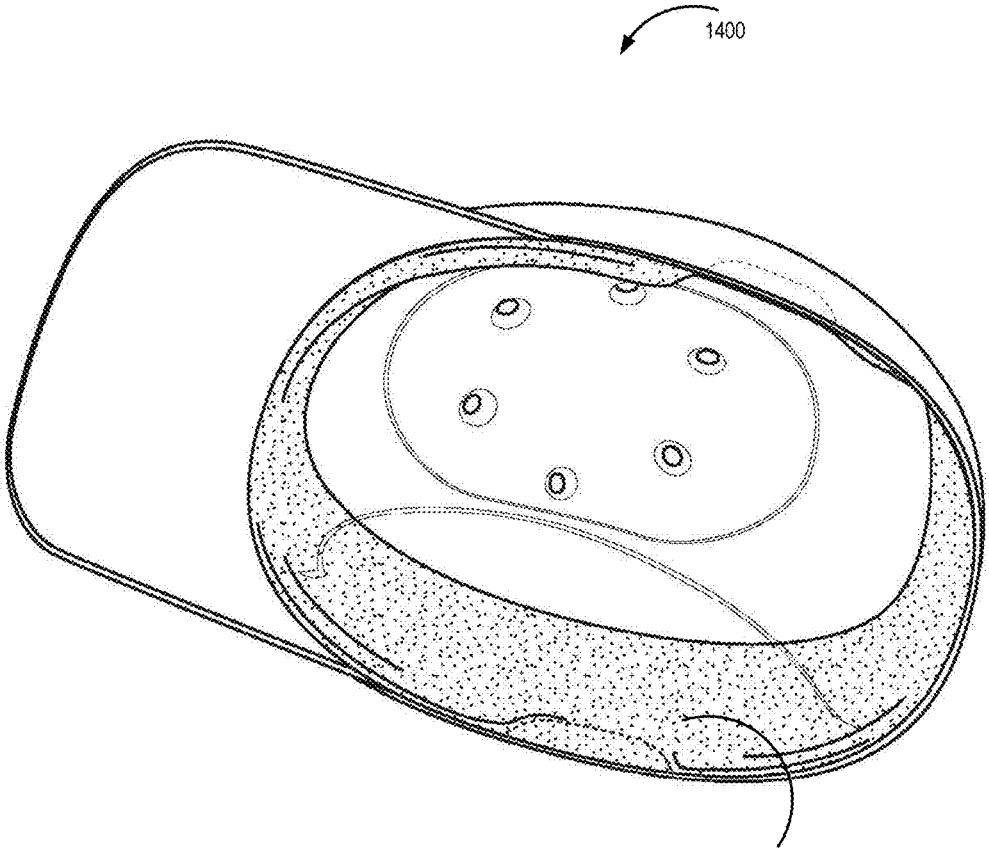

FIGS. 13 and 14 show a cap assembly 1300, 1400 with an outer hard shell and foam liner inserted into a cap where the cap includes an elastic sweat band 114' which covers the entire ear cut out portion of the foam liner and hard outer shell.

Figure 15:
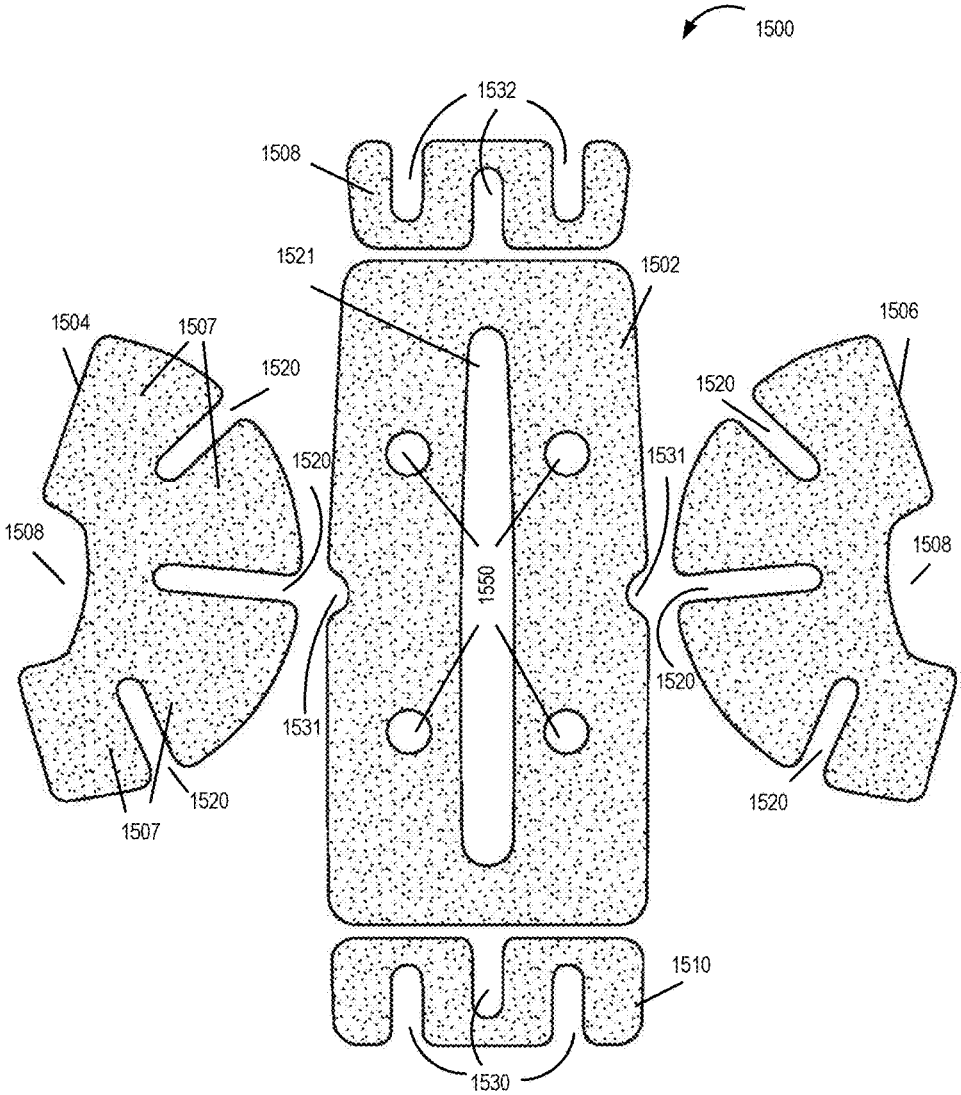
FIG. 15 illustrates a set of foam cutouts which, in some embodiments, are secured to the inside of the hard outer shell and used in place of the foam liner shown in the FIG. 1 embodiment.

FIG. 15 illustrates a set of foam cutouts which, in some embodiments, are secured to the inside of the hard outer shell and used in place of the foam liner shown in the FIG. 1 embodiment. The foam cutouts include front 1508, rear 1510, left 1504 and right 1506 foam cutouts which may be cut, stamped or otherwise formed from flat sheets of foam material. A center foam cutout 1502 corresponds to the top center portion of the helmet. The foam cutouts 1502, 1508, 1510, 1504, 1506 are secured using adhesive to the inside of a hard outer shell such as the shell 120 shown in FIG. 1. The foam cutouts can be inserted into the hard outer shell as shown in FIG. 16 where the shell is identified using reference number 1602.

The foam inserts shown in FIG. 15 include solid portions of foam with various notches 1520, 1532, 1530 holes 1550, slits 1521 and cutouts 1508, 1531. These allow the foam inserts to be flexed and secured to the inside of the hard outer shell without creating uncomfortable ridges or creases which might be felt by the wearer. They also facilitate ventilation with the holes 108 in the cap lining up with one or more of the holes, slits or notches in the foam liner. The left and right liner inserts 1504, 1506 include an ear cutout 1508 and have the form of four tables 1507 which are joined together along the bottom portion of the individual inserts above the ear cutout 1508.

Like the side foam inserts, the front and rear foam inserts 1508, 1510 include a plurality of slits 1532, 1520 which allow the inserts to conform to the contour of the hard outer shell when secured thereto without creating uncomfortable ridges and while allowing for adequate air flow from the bottom of the helmet up toward the top center portion where it can be vented.

Figure 16:
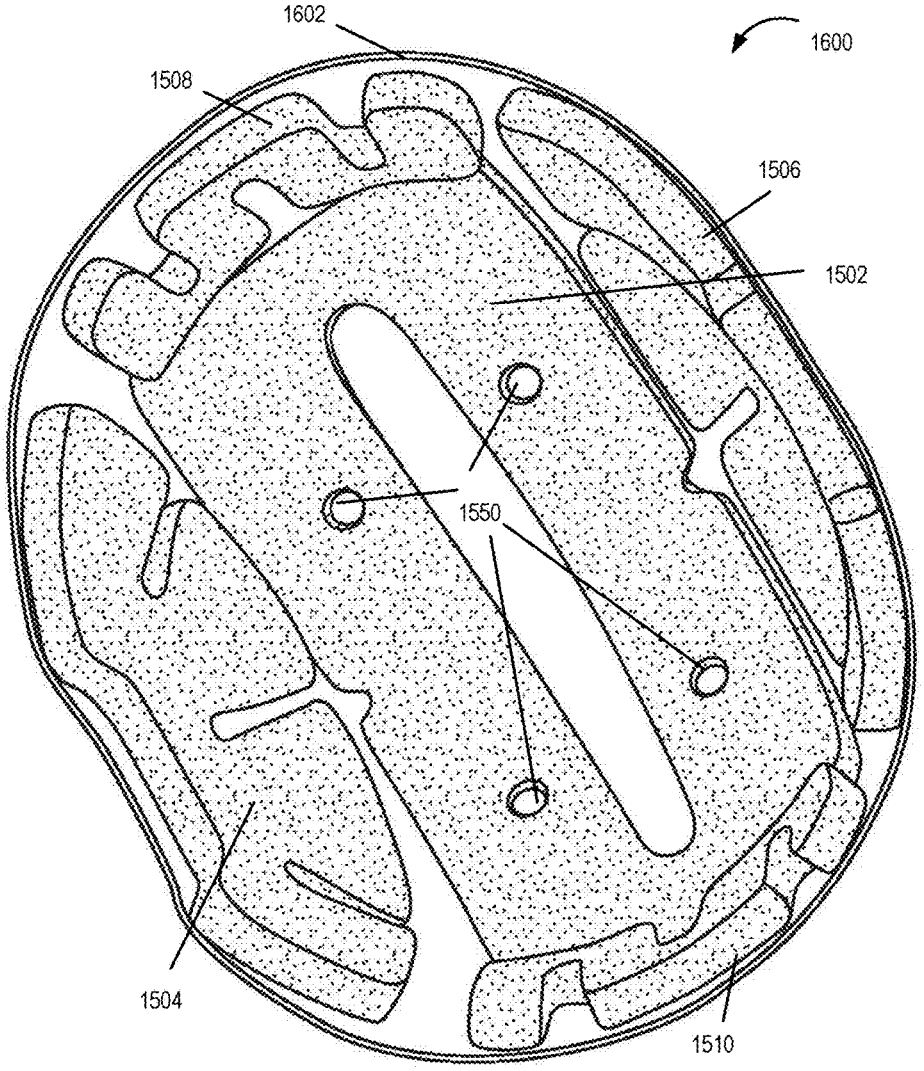
FIG. 16 is a bottom view of the headgear assembly of FIG. 15 including the foam cutouts secured to a hard outer shell.

FIG. 16 is a bottom view of the headgear assembly of FIG. 15 including the foam cutouts secured to a hard outer shell 1602. As can be seen, while providing protection in each of the front, rear, top, left and right sides of the outer shell and thus to the corresponding portions of a wear's head, adequate gaps are left between the foam inserts to enable adequate ventilation and air flow particularly when the notches and other cutouts of the foam inserts are taken into consideration.

Figure 17:
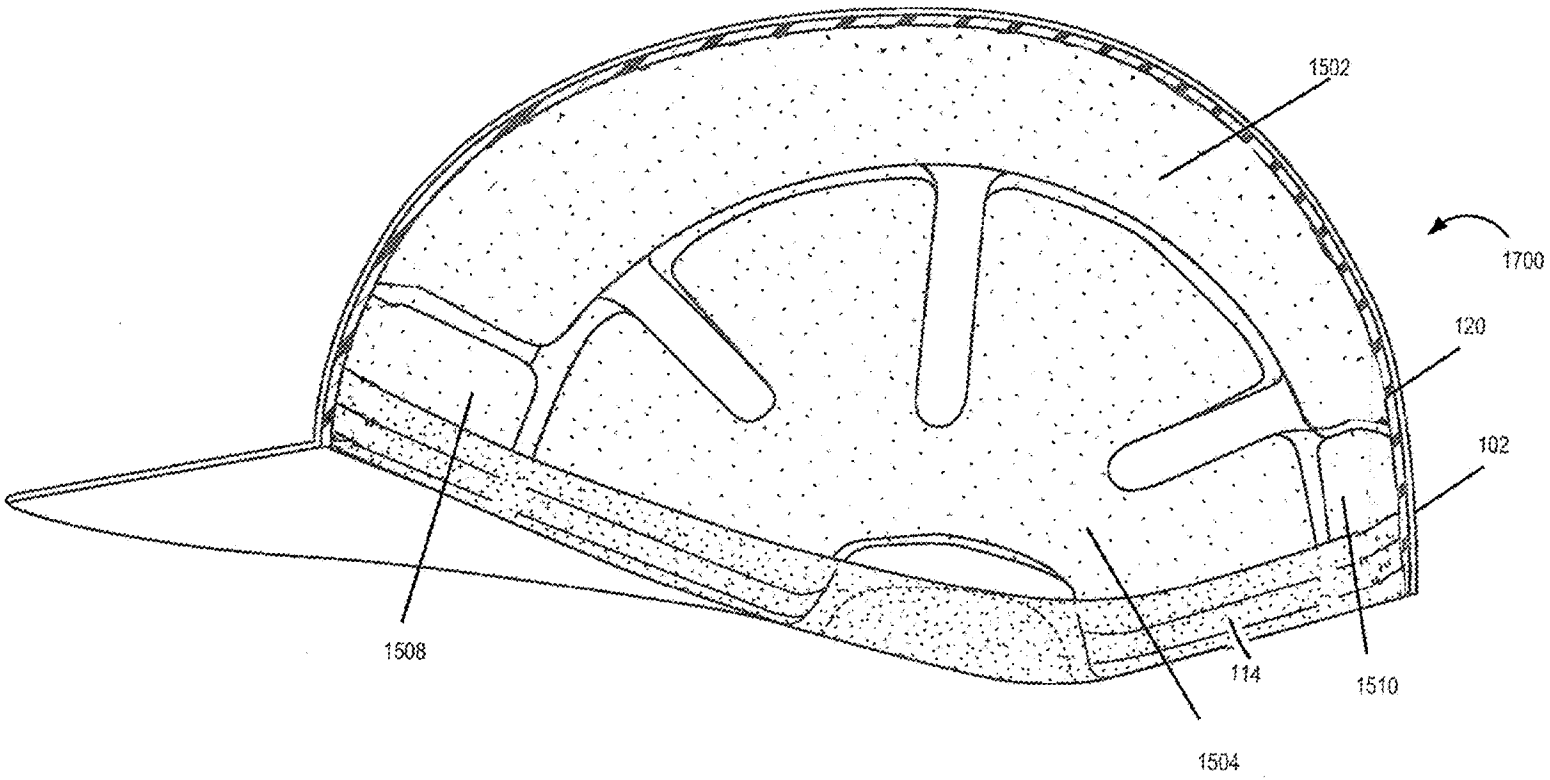
FIG. 17 is a cross-section view of an exemplary headgear assembly implemented using the foam cutouts shown in FIGS. 15 and 16.

FIG. 17 is a cross-section view 1700 of an exemplary headgear assembly implemented using the foam cutouts shown in FIGS. 15 and 16. The hard outer shell 120 with the foam liners 1508, 1504, 1510, 1502 secured thereto fits snugly within the cap 102 from which it can be inserted and removed.

The FIG. 17 embodiment is particularly well suited for golf applications where a heavy foam liner is not required but some amount of foam is desirable to dissipate energy from a ball impact.

In some embodiment the foam inserts are in the range of 3 mm to 9 mm in thickness with 8 mm working well in several embodiments. However, 4 and 6 mm thickness can, and are used in some embodiments.

As can be appreciated, depending on the embodiment, the thickness of the hard outer shell and foam may vary. In some embodiments the hard outer shell may be of uniform thickness. Similarly, the foam inserts and/or foam liner may be of uniform thickness. It is contemplated that in police cap embodiments and/or security embodiments where the direction and/or type of impact is less predictable, uniform hard outer shell and foam liner/insert thicknesses may be desirable. The headgear assemblies of the present invention can provide security officers with a surprisingly high level of protection from being hit in the head with bottles, sticks and/or other objects without giving the appearance of a large security helmet.

While illustrated in the context of a baseball or golf cap, it should be appreciated that the protective headgear may be configured to be used with a wide variety of caps where a cap is used in a manner intended to refer to any type of hat that may be placed over the hard outer shell of the present invention. A cap may include such hats such as toques or beanies.

However, it should be appreciated that the methods and apparatus of the present invention are particularly well suited to baseball cap, golf cap and other types of applications where caps are commonly worn.

While the caps are shown in most example included herein with a brim that provides shade, in one embodiment the brim is omitted and the protective headgear assembly is implemented as a cloth cap with a hard outer shell and a foam liner or foam inserts. Such an embodiment is well suited for base coaches who might want to place the protective headgear assembly over a regular baseball cap so that it can be removed easily from the head without having to remove a baseball cap that is being worn. In one such embodiment the fabric cap covering the hard outer shell is made of a material which matches the baseball cap in color and texture making the protective headgear less noticeable than if the cap was made out of a material that did not match the baseball cap being worn by the base coach. Thus the base couch embodiment could include a cap without a rim, hard shell and foam liner or foam inserts. In this way, the protective headgear (without a brim) could be placed on top of a regular baseball cap and the combined unit would have the appearance similar to that of a regular baseball cap but would provide protection. In cases where the wearer wishes to remove the protective assembly and wear the regular cap, it could easily be accomplished since the protective headgear goes over the regular cap rather than inside it. Baseball base coaches or umpires may wish to use this model in between innings.

Numerous additional variations on the above described embodiments are possible without departing from the scope of the invention.

What is claimed is:

1. A protective assembly to be worn on a head, the assembly comprising:

a hard outer shell including a plurality of ventilation holes in a top portion of said hard outer shell; and a plurality of foam inserts secured to an inner surface of said hard outer shell, said foam inserts including a front foam insert, a rear foam insert, a left side foam insert, a right side foam insert and a top foam insert, said top foam insert including a top portion including a plurality of holes arranged around a solid portion at the center of which is a slit, said slit corresponding to the center of said top portion of the hard outer shell, said holes in the top foam insert lining up with the ventilation holes in the top portion of the hard outer shell and holes in a top of a cap when the cap is placed over the hard outer shell to which the foam inserts are secured.

2. The protective assembly of claim 1, wherein said foam inserts are made from flat pieces of foam material which are secured to the contoured inside surface of said hard outer shell using an adhesive.

3. The protective assembly of claim 1, wherein said left side and right side foam inserts include at least three notches each and include four tables of foam material which are joined together by a foam portion placed above an ear cutout in said hard outer shell, the foam portion placed above the ear cutout including a recessed area which extends upward towards an upper notch, said upper notch being one of said three notches.

4. The protective assembly of claim 3, wherein said foam inserts are less than 9 mm thick.

5. The protective assembly of claim 3, wherein the protective assembly further includes said cap, said cap being a fabric cap including multiple holes, said cap being placed over said hard outer shell.

6. The protective assembly of claim 3, wherein said cap includes a brim and a rivet at a top center portion of said cap.

7. The protective assembly of claim 6, wherein said cap includes an elastic band around the inside rim of the cap.

8. The protective assembly of claim 6, wherein said front foam insert includes a solid lower foam portion at the bottom center front portion of said hard outer shell and an upward extending notch above said solid lower foam portion, said solid lower foam portion of the front foam insert being flanked on the left side by a first downward extending notch in the front foam insert and on the right side by a second downward extending notch in the front foam insert.

9. The protective assembly of claim 8, wherein said rear foam insert includes a solid lower foam portion at the bottom center rear portion of said hard outer shell and an upward extending notch above said solid lower foam portion of said rear foam insert, said solid lower foam portion of the rear foam insert being flanked on the left side by a first downward extending notch in the rear foam insert and on the right side by a second downward extending notch in the rear foam insert.

10. The protective assembly of claim 9, wherein the left side foam insert includes a recessed area over a region corresponding to an ear of a user, said recessed area extending upward towards the upper notch leaving a portion of the inner surface of the hard outer shell exposed while left and right portions of the foam portion extend closer to the bottom of said hard outer shell than said recessed area.

11. The protective assembly of claim 3, wherein the left side foam insert includes a recessed area over a region corresponding to an ear of a user, said recessed area extending upward towards the upper notch leaving a portion of the inner surface of the hard outer shell exposed while left and right portions of the foam portion extend closer to the bottom of said hard outer shell than said recessed area.

12. The protective assembly of claim 1, wherein said cap includes a brim, said cap being closed at a top center portion of said cap and including multiple holes surrounding said closed top center portion which align with holes in said hard outer shell and holes in the top foam insert.

13. The protective assembly of claim 12, wherein said cap includes an elastic band around the inside rim of the cap.

* * * * *